United States Patent [19]

Howard

[11] Patent Number: 5,042,214

[45] Date of Patent: Aug. 27, 1991

[54] SELF-LOCKING CEILING PANELS

[75] Inventor: Charles I. Howard, Bellevue, Wash.

[73] Assignee: Howard Manufacturing Company, Kent, Wash.

[21] Appl. No.: 541,252

[22] Filed: Jun. 20, 1990

[51] Int. Cl.[5] ..... E04B 5/52

[52] U.S. Cl. ..... 52/507; 52/581; 52/342

[58] Field of Search ..... 52/581, 473, 342, 664, 52/507, 509; 256/24

[56] References Cited

U.S. PATENT DOCUMENTS

| | | | |
|---|---|---|---|
| 3,080,674 | 3/1963 | Amici | 52/592 |
| 3,554,850 | 1/1971 | Kuhle | 52/592 |
| 4,067,196 | 1/1978 | Schraudenbach | 52/581 |
| 4,608,798 | 9/1986 | Spiers | 52/581 |

FOREIGN PATENT DOCUMENTS

| | | | |
|---|---|---|---|
| 1062420 | 7/1959 | Fed. Rep. of Germany | 52/828 |
| 1084899 | 1/1955 | France | 52/828 |

*Primary Examiner*—Richard E. Chilcot, Jr.
*Assistant Examiner*—Joanne C. Downs
*Attorney, Agent, or Firm*—Christensen, O'Connor Johnson & Kindness

[57] ABSTRACT

A self-locking panel assembly for use as ceiling panels comprising a plurality of panel units. Each panel unit formed ou of on or more panel elements and a rail extending across the panel elements.The rail is formed out of a lower section and an upper section that are offset from each other such that at one end of the unit the lower section forms a tongue sticking out, and at the opposite end, the upper section, in combination with the panel element, forms a slot dimensioned to receive the tongue. The ends of the rail are complementary and nonlinear such that they fit together. The panel units of this invention are installed in place. The rail of a first panel locks in place with the rail and panel element of the adjacent panel. The edges of the adjacent panels are thus restricted from movement so as to limit the individual free movement of separate panels.

14 Claims, 2 Drawing Sheets

SELF-LOCKING CEILING PANELS

FIELD OF THE INVENTION

This invention relates generally to panels used in construction, such as ceiling panels, and, more specifically, to self-locking and self-spacing panels ceiling panels that can readily be fitted in place.

BACKGROUND OF THE INVENTION

In many structures, such as office buildings, apartments, and the like, panel assemblies are used to provide a cosmetic ceiling between the actual ceiling and the occupied portion of the structure. Individual panel units, that form these assemblies, provide an aesthetically pleasing covering over service lines, such as ventilating ducts and electrical lines, and the unfinished actual ceiling. These panels can be secured in place by nails, screws or other fasteners that hold the panels to overhead frame members. Alternatively, each panel may be provided with clips that are snap-fitted to the grid members or cross tees that are suspended from the ceiling.

When the panels are being secured to the overhead frame members, they must be properly aligned or the final appearance of the ceiling will suffer. During instillation, it is difficult hold a panel steady so that it is properly positioned relative to the adjacent panels. This is in part because the panels are located above the heads of the workers performing the installation so as to put the panels in an awkward position to hold. Also, the act of driving a fastener through the panel and complementary frame member vibrates the panel so as to cause it to shift position. Consequently, the process of holding a panel steady while it is being installed is a bothersome task that takes some skill and patience to perform.

Moreover, in many panel assemblies, the individual panel units are disconnected from each other and maintained in assembly only by the supporting structure. Consequently, the panels are unable to support each other in the event the panels are struck or exposed to excessive vibrations. The former situation can occur in many environments where the panels are used when individuals inadvertently strike a panel with an object such as a ladder or a ball. A panel might also shift position because of the normal vibrations of the service lines located near the panel or as a result of the normal vibrations of the overlying actual ceiling, which often functions as a floor for another level of the structure. Panel vibrations are also a problem for structures located in earthquake zones. Regardless of the cause, once a panel unit starts to move, it can work free of the supporting structure to which it is attached. Once that occurs, the panel will fall to the floor and have to be refitted in place. This may involve removing and reinserting a number of panels so that they will appear uniformly fitted together. Moreover, when a panel falls from the ceiling, there is a likelihood that any persons standing underneath will be struck and injured.

SUMMARY OF THE INVENTION

This invention is directed to a system for securing panels, such as ceiling panels, in place. More particularly, the invention is directed to self-locking panels that interlock when installed. The system of this invention ensures that, once a set of panels is installed, the individual panels will be restricted from moving and falling away.

The system of this invention includes providing panels with rails that, in combination with the actual panel elements themselves, interlock adjacent panels. The opposite end faces of the rails have complementary surfaces so that the ends of adjacent rails on adjacent panels interconnect. The rails are also formed out of upper and lower sections that are offset from each other. At one end of the rail, the upper section is stepped from the lower section so that the lower section forms a tongue that extends beyond the edge of the panel element. At the opposite end of the rail, the upper section projects out over the lower section so as to, in combination with the panel element, define a slot dimensioned to receive the lower section tongue.

The panels of this invention are mounted to the complementary support members. Adjacent panels are fitted together so that the rail lower section tongue of one panel is fitted into the slot formed by the rail upper section and panel element of the adjacent panel. The complementary end faces of the rails prevent the panels from shifting position in the plane of the panels. The tongue-in-slot arrangement of the rails and panel elements prevents panel movement perpendicular to the panel plane.

An advantage of these panels is that once a panel is properly positioned during the instillation process, it is held in place. The panel will not shift sideways, or pitch at an angle from the plane of the panels. Only a minimal amount of effort is required to hold the panels of this invention in proper position for instillation. This reduces the time and expense of installing these panels.

Furthermore, should a panel of this invention be struck or be subjected to vibration, the interlocking panel elements and rails hold it in place. The panel will not work free of the support members to which it is attached. This invention thus substantially eliminates the possibility that panels will fall from the ceiling so as to at least require reattachment, or at the worst, be a potential source of injury.

BRIEF DESCRIPTION OF THE DRAWINGS

This invention will be pointed out with particularity in the appended claims. The above and further advantages of the invention may be better understood by reference to the following detailed description, taken in conjunction with the accompanying drawings in which:

DETAILED DESCRIPTION OF THE PREFERRED EMBODIMENT

Figure 1:
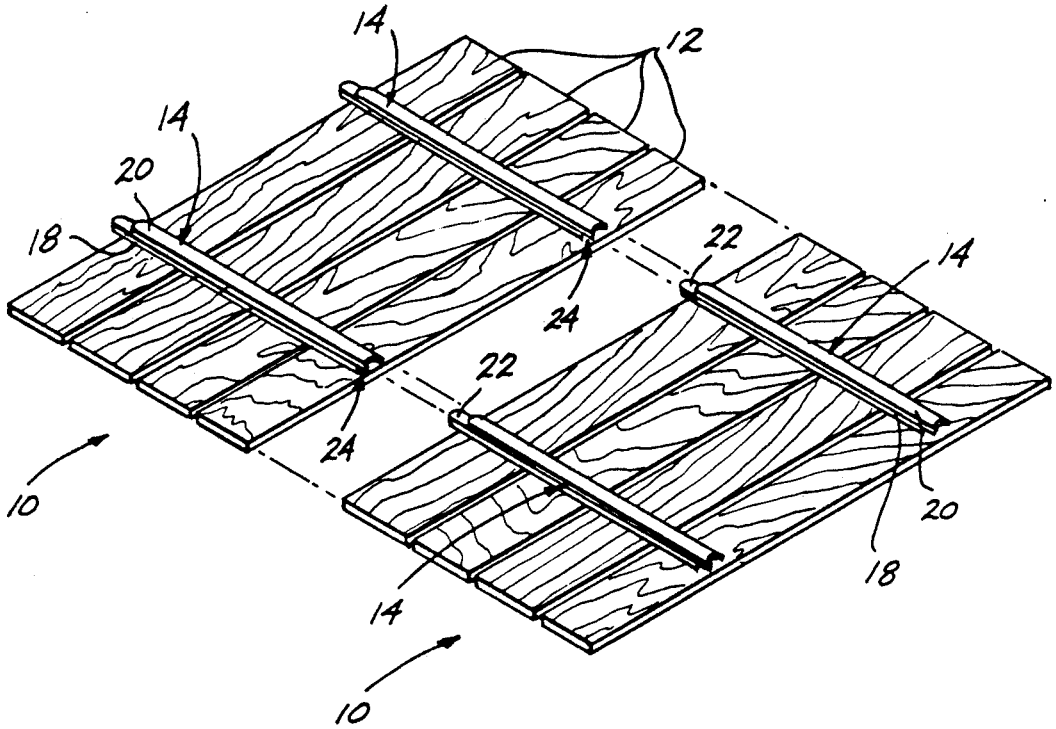
FIG. 1 is a perspective view of two spaced-apart panels constructed according to this invention.

FIG. 1 depicts two spaced-apart panels 10 constructed in accordance with this invention. Each panel 10 is formed from a number of parallel, spaced apart slats 12 that are connected by two rails 14 that extend perpendicularly across the slats. Nails, construction staples, or other fastening means (not illustrated) are used to secure the rails 14 to the slats 12. The rails 14 are shaped, and are positioned relative to the slats 12, so that when two panels 10 are placed together, the rails of one panel interlock with the rails and the closest slat of the adjacent panel.

Figure 2:
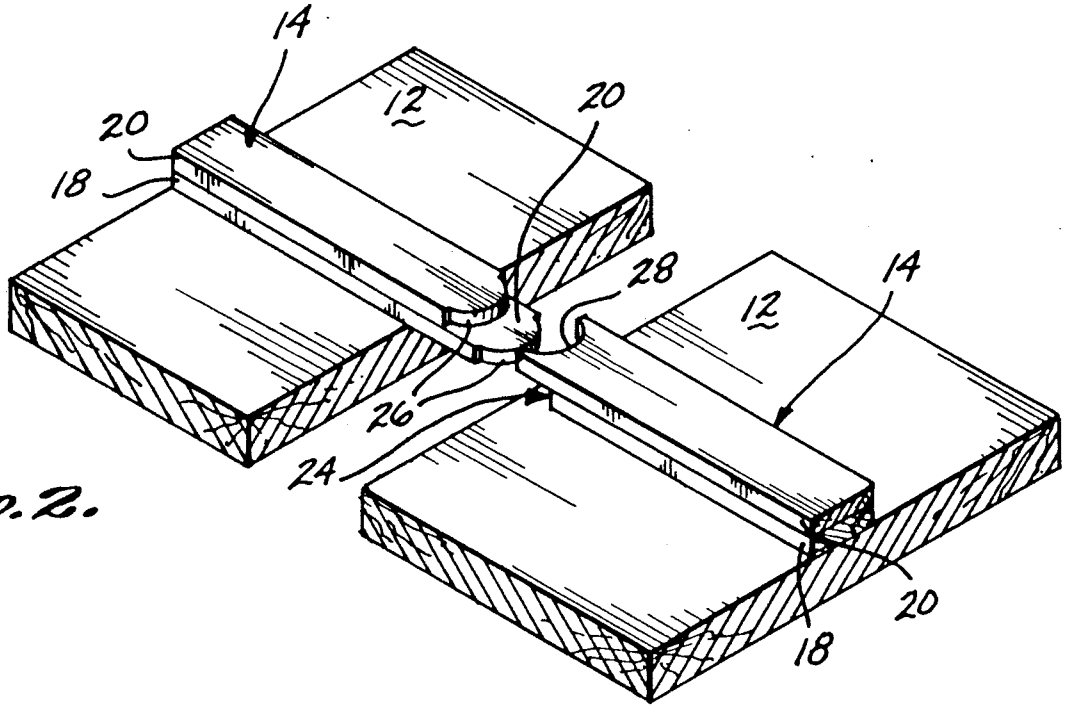
FIG. 2 is a perspective detail view of the panels of FIG. 1, illustrating how the individual rails on adjacent panels interconnect.

As depicted in FIGS. 1 and 2, each rail 14 is formed from a lower section 18 disposed against the slats 12 and an upper section 20 located on top of the lower section. The lower and upper sections, 18 and 20 respectively, are of equal length and are offset longitudinally from each other in assembly. The end of the rail lower section 18 forms a tongue 22 that extends beyond the outside edge of the outermost slat 12. When the rails are fitted together, the rail lower section tongue 22 fits into a slot 24 formed by the adjacent rail upper section 20 and the underlying slat 12 of the adjacent panel 10.

The rails 14 are further shaped so that the ends of each rail have complementary, nonlinear edges. In the depicted embodiment of the invention, the rail lower and upper sections, 18 and 20 respectively, at the stepped end of the rail have outwardly curved convex faces 26. At the opposite end of the rails 14, the upper and lower sections, 18 and 20 respectively, are formed with inwardly curved concave faces 28. The complementary shape of the edges 26 and 28 provides them with a tongue-and-groove coupling when adjacent rails 14 are fitted together.

Figure 3:
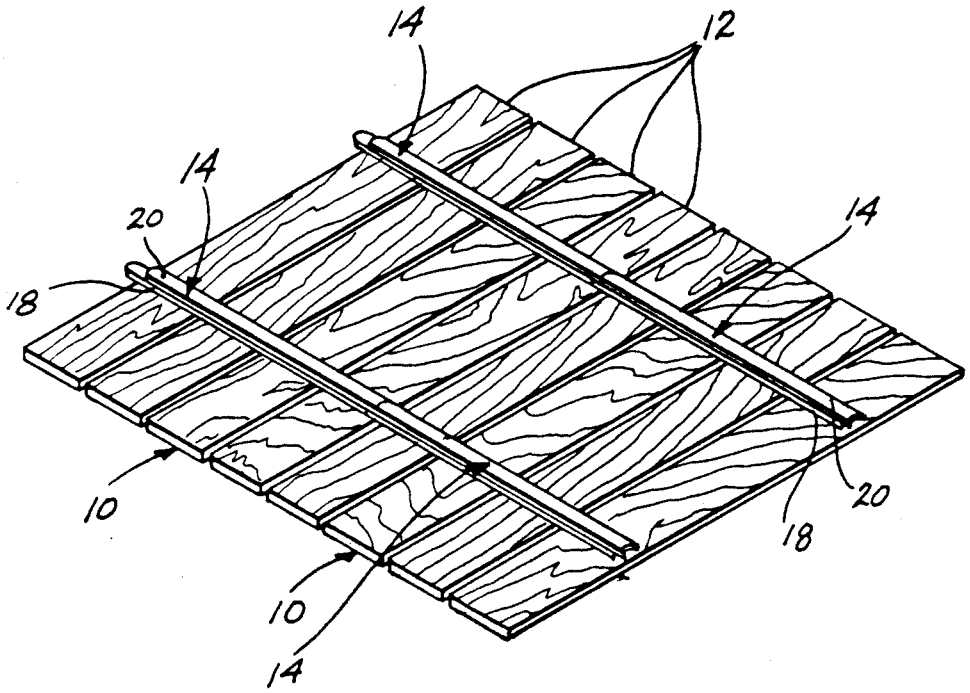
FIG. 3 is a perspective view of the panels of FIG. 1, illustrating how two panels are interconnected according to this invention.
Figure 4:
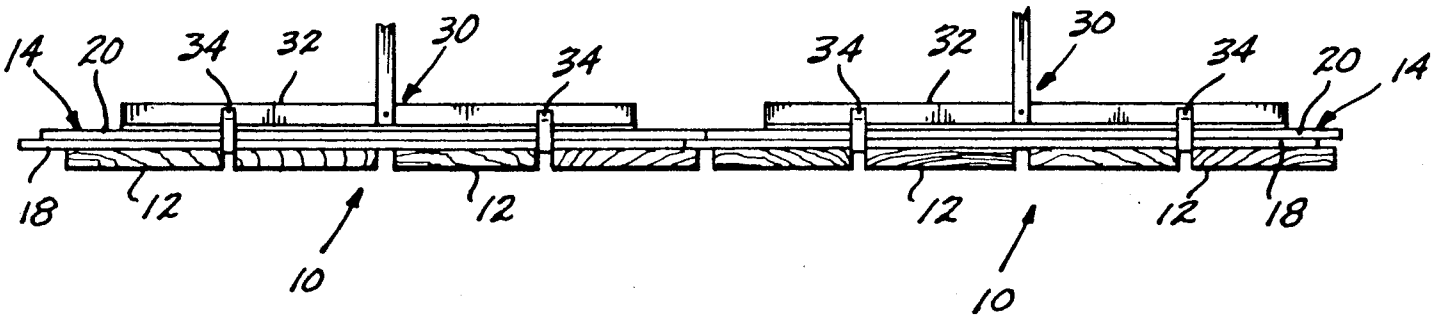
FIG. 4 is a sectional view illustrating how two panels are assembled as ceiling panels according to this invention.

When the panels 10 are assembled together, the rails 14 of one panel interlock with the rails and adjacent slat 12 of the next panel as illustrated in FIG. 3. The rail lower section tongues 22 on one panel 10 are fitted into the slots 24 defined adjacent the edge of the next panel. As further depicted in FIG. 4, the panels can be so interlocked when they are used as ceiling panels and are suspended from cross tees 30. In this instance, the individual panels are secured to the horizontal member 32 of the cross tee by clips 34 that are attached to the rails 14 in the gaps located between adjacent slats 12. The clips 34 snap-secure the individual panels 10 to the cross tees 30. When the panels 10 are secured to the cross tees 30, the panels are fitted together by fitting the rail lower section tongues 22 of a to-be-installed panel into the slots 24 of the adjacent, already installed panel.

When the panels 10 constructed according to this invention are assembled together, the complementary faces 26 and 28 respectively, of the abutting rails 14 prevent the shifting of adjacent panels of the plane in which they lie. The fitting of tongue 22 of each lower section 18 into the space defined by slot 24 of the rail upper section 20 and by the underlying slat 12 of the adjacent panel prevents the panels 10 from moving perpendicularly to the panel plane. Thus, independent movement of panels 10 of this invention is restricted.

Each panel 10 of this invention is secured in place as soon as it is properly positioned against an adjacent, already installed panel. Consequently, the newly positioned panel does not shift position when a fastener is being driven through it and the overhead support frame in order to secure it in place. This simplifies the skill required to install the panels 10 of this invention and also reduces the cost and expense of their installation.

The individual panels 10 are not dislodged if they are struck or are subjected to vibration. Thus, if a panel is hit by an object, or the structure in which the panels are in place is subjected to an earthquake, the panels will remain secured to the structure. Thus the need to be concerned about falling panels being the source of injury and the need to be concerned about reinstalling falling panels are substantially eliminated.

Moreover, since the panels 10 interlock, individual panels are prevented from movement out of the panel plane that can occur as a result of the contraction or expansion of the material forming the panel. In other words, the individual panels 10 of this invention are held in place so as to be prevented from warping.

Also, the panels 10 of this invention are self spacing. That is, in embodiments of the invention, such as the described embodiment, where the panel elements, the slats 12, are arranged to be spaced apart from each other, the adjacent panel elements of the adjacent panels are spaced from each other by a uniform distance. This is accomplished by dimensioning the rails 14 so that each their ends with the lower section tongues 22 extend out an appropriate distance beyond the outer edge of the underlying slat 12. Thus, the invention makes it possible to space the panel elements apart from each by a consistent length in order to create a particular aesthetic impression.

Another advantage of the panels 10 is that even though they interlock, they do not require any additional components such as clamps or tie elements. Moreover, the panels 10 do not require special tools for their installation, nor are large amounts of time required for their installation. Thus, the panels 10 of this invention are both relatively economical to produce.

The foregoing description has been limited to a specific embodiment of this invention and it is understood to be offered for the purposes of illustration only. It is readily recognized that this system for interlocking panels can be practiced with alternative means than those that have been disclosed. For example, this invention does not necessarily have to be used with panel elements formed out of individual spaced-apart slats 12. It is readily apparent that the invention can be practiced with panel elements formed out of single sections of material, such as single sections of wood or acoustical tiling. Moreover, the exact arrangement and shape of the rails 14 disclosed is similarly understood to be illustrative and not limiting. The complementary rail end section edges need not be the described curves. In some embodiments of the invention, it may be desirable to form the rail faces 26 and 28 with a sawtooth arrangement or other shapes of non-linear complementary protuberances and indentations that interlock. Similarly, it is not necessary that the concave or outwardly jutting face be associated with the rail lower section 18 that forms the outwardly extending tongue. In some embodiments of the invention, it may be desirable that this face be formed with a concave shape.

It is still further understood that the described embodiment wherein the rails are formed of two sections is similarly only exemplary. It may be desirable in some versions of the invention to provide a rail formed of three or more sections. In this construction of the invention, the individual sections would be staggered from each other so that they would interlock in a manner similar to interlocking gear teeth. The described and illustrated construction of the invention with two rails 14 is also understood to be exemplary. Clearly panels can be constructed according to this invention out of one, three or more rails 14.

Therefore, it is an object of the appended claims to cover all such modifications and variations as come within the true spirit and scope of the invention.

The embodiments of the invention in which an exclusive property or privilege is claimed are defined as follows:

1. A ceiling panel assembly comprising a plurality of panel units, each panel unit including:

at least one panel element with two opposed edges arranged to be positioned adjacent said edges of an adjacent said panel unit;

at least one rail attached to said panel element and extending between said panel element opposed edges, said at least one rail including a lower section attached to said panel element and an upper section attached to said lower section, said rail sections being offset from each other so that at a first end said rail lower section defines a tongue extending beyond an adjacent said panel element edge and at a second end said rail upper section and said panel element define a slot dimensioned to receive said rail lower slot tongue so as to limit longitudinal movement of said panel units in a plane established by said panel units and movement of said panel unit perpendicular to said plane and wherein said opposed ends of said rail have complementary, non-linear faces whereby when rail faces of adjacent said panel units interlock, lateral movement of said panel units is restricted.

2. The ceiling assembly unit of claim 1, wherein each said panel unit further comprising a plurality of panel elements including two outermost panel elements defining said two opposed edges and wherein said at least one rail extends approximately perpendicularly across said panel elements and is attached to said panel elements.

3. The ceiling panel assembly of claim 1 wherein said rail lower slot tongue has a face with at least one protuberance extending beyond lateral edges of said rail section and said opposed end of said rail lower section defines at least one indentation which is dimensioned to receive said protuberance.

4. The ceiling panel assembly of claim 1 wherein said rail lower slot tongue and said adjacent end of said rail upper section have identical protuberances that extend beyond lateral edges of said rail sections and said opposed ends of said rail lower and upper sections define indentations which are dimensioned to receive said protuberances.

5. The ceiling panel assembly of claim 4, wherein said rail lower and upper section first faces have convex edges and said rail lower and upper section second faces have complementary concave edges.

6. A ceiling panel unit comprising:

at least one panel element with two opposed edges arranged to be positioned adjacent another said panel unit;

at least one rail attached to said panel element and extending between said panel element opposed edges, said at least one rail including a lower section attached to said panel element and an upper section attached to said lower section, said rail sections being offset from each other so that at a first end said rail lower section defines a tongue extending beyond an adjacent said panel element edge and at a second end said rail upper section and said panel element define a slot dimensioned to receive said rail lower section tongue and wherein said opposed ends of said rail have complementary, non-linear faces whereby when adjacent panel units are interlocked, the rail lower section tongue of a first panel unit is fitted in said slot of a second panel unit to restrict longitudinal movement of said first panel and limit movement of said first panel unit out of a plane defined by said panel units and said rail end faces prevent lateral movement of said panel units.

7. The ceiling panel unit of claim 6, further comprising a plurality of panel elements including two outermost panel elements defining said two opposed edges and wherein said at least one rail extends approximately perpendicularly across said panel elements and is attached to said panel elements.

8. The ceiling panel unit of claim 6 wherein said rail lower slot tongue has a face with at least one protuberance extending beyond lateral edges of said rail section and said opposed end of said rail lower section defines at least one indentation which is dimensioned to receive said protuberance.

9. The ceiling panel unit of claim 6 wherein said rail lower slot tongue and said adjacent end of said rail upper section have identical protuberances that extend beyond lateral edges of said rail sections and said opposed ends of said rail lower and upper sections define indentations which are dimensioned to receive said protuberances.

10. The ceiling panel unit of claim 9, wherein said rail lower and upper section first faces have convex edges and said rail lower and upper section second faces have complementary concave edges.

11. A ceiling panel assembly comprising a plurality of panel units, each panel unit including:

at least one panel element with two opposed edges arranged to be positioned adjacent said edges of an adjacent said panel unit;

at least one rail attached to said panel element and extending between said panel element opposed edges, said at least one rail including a lower section attached to said panel element and an upper section attached to said lower section, said rail sections being offset from each other so that at a first end said rail lower section defines a tongue extending beyond an adjacent said panel element edge and at a second end said rail upper section and said panel element define a slot dimensioned to receive said rail lower slot tongue so as to limit longitudinal movement of said panel units in a plane established by said panel units and movement of said panel unit perpendicular to said plane and wherein said opposed ends of said rail have faces with convex edges at a first end and with complementary concave edges at a second, opposed end of said rail.

12. The ceiling assembly of claim 11, wherein said panel unit further comprises a plurality of panel elements including two outermost panel elements defining said two opposed edges and wherein said at least one rail extends approximately perpendicularly across said panel elements and is attached to said panel elements.

13. A ceiling panel unit comprising:

at least one panel element with two opposed edges arranged to be positioned adjacent the edges of an adjacent said panel unit;

at least one rail attached to said panel element and extending between said panel element opposed edges, said at least one rail including a lower section attached to said panel element and an upper section attached to said lower section, said rail sections being offset from each other so that at a first end said rail lower section defines a tongue extending beyond an adjacent said panel element edge, and at a second end, said rail upper section and said panel element defines a slot dimensioned to receive said rail lower slot tongue and wherein said opposed ends of said rail have faces with convex edges at a first end and with complementary concave edges at a second, opposed end of said rail.

14. The ceiling panel unit of claim 13, wherein said panel unit further comprises a plurality of panel elements including two outermost panel elements defining said two opposed edges and wherein said at least one rail extends approximately perpendicularly across said panel elements and is attached to said panel elements.

* * * * *

UNITED STATES PATENT AND TRADEMARK OFFICE

CERTIFICATE OF CORRECTION

PATENT NO. : 5,042,214
DATED : August 27, 1991
INVENTOR(S) : Charles I. Howard

It is certified that error appears in the above-identified patent and that said Letters Patent is hereby corrected as shown below:

| COLUMN | LINE | |
|---|---|---|
| 1 | 47 | "vibrations" should be --vibration-- |
| [57]Abstract | 3,4 | "unit forms ou of on or more" should be --unit is formed out of one or more-- |

Signed and Sealed this

Ninth Day of November, 1993

Bruce Lehman

*Attest:*

BRUCE LEHMAN

*Attesting Officer*

*Commissioner of Patents and Trademarks*